US007003905B1

(12) United States Patent
Derges

(10) Patent No.: US 7,003,905 B1
(45) Date of Patent: Feb. 28, 2006

(54) CANDLE OR SCENTED-WAX BOOK OR CARD

(76) Inventor: Patricia A. Derges, 601 E. South St., Ozark, MO (US) 65721

( * ) Notice: Subject to any disclaimer, the term of this patent is extended or adjusted under 35 U.S.C. 154(b) by 72 days.

(21) Appl. No.: 10/838,874

(22) Filed: May 3, 2004

Related U.S. Application Data

(60) Provisional application No. 60/467,736, filed on May 2, 2003.

(51) Int. Cl.
*G09F 1/00* (2006.01)

(52) U.S. Cl. ..... 40/124.11; 431/288; 431/289

(58) Field of Classification Search ..... 40/124.11; 431/125, 288, 289; D26/6, 7
See application file for complete search history.

(56) References Cited

U.S. PATENT DOCUMENTS

D456,538 S * 4/2002 Leeds ..... D26/6
D458,394 S * 6/2002 Leeds ..... D26/6
6,413,617 B1 * 7/2002 Schlier ..... 428/195.1
6,709,265 B1 * 3/2004 Guzman ..... 431/289
6,817,122 B1 * 11/2004 Bokis ..... 40/124.01
2004/0031722 A1 * 2/2004 Reed ..... 206/575
2005/0160638 A1 * 7/2005 Donnelly ..... 40/124.06

* cited by examiner

*Primary Examiner*—Gary C. Hoge
(74) *Attorney, Agent, or Firm*—Jonathan A. Bay

(57) ABSTRACT

A wax greeting card or waxen gift book-covers has a pair of matching panels, one a front and the other a back panel substantially of wax. Each panel has inner and outer faces framed by a perimeter of spaced upper and lower edges as well as a spaced spine and fore edge. Such wax greeting card or gift book-covers further includes a flexible hinge extending across the spine edges of the front and back panels, which flexible hinge is and anchored in each panel by being cemented or embedded in the wax thereof. The flexible hinge allows relative movement between the front and back panels that ranges from a shut closed position to various spread open positions.

18 Claims, 6 Drawing Sheets

CANDLE OR SCENTED-WAX BOOK OR CARD

CROSS-REFERENCE TO PROVISIONAL APPLICATION(S)

This application claims the benefit of U.S. Provisional Application No. 60/467,736, filed May 2, 2003.

BACKGROUND AND SUMMARY OF THE INVENTION

The invention relates to candles or scented-wax hardgoods and more particularly to a candle or scented-wax book or card.

The invention, among other things, combines (i) the attributes of a greeting card such as occasion marking, greeting exchanging, or keepsake memento; along with (ii) the scented-wax hardgood attributes as a disguised air-freshener, as well as with (iii) the attributes of a decoration or ornament for accessorizing or gracing households, apartments, offices, hospital rooms or like environs; and further with (iv) other attributes of a candle such as enhancing a mood, ceremony or celebration by flicker of a flame.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings, FIGS. 1 through 12 are a set of pictorial views wherein, FIG. 1 is a pictorial view of various preferred embodiments of candle or scented-wax books or cards in accordance with the invention.

FIG. 2 is a view comparable to FIG. 1 except that the two books (or cards) featured in the foreground are shown spread half-open to better show how they may be arranged self-standing at the same time allowing viewing into the matters on the panels' inner surfaces.

FIG. 3 is a view comparable to FIG. 2 except showing the front and back panels' outer surfaces.

FIG. 4 is a view comparable to FIG. 3 except showing the front and back panels' inner surfaces.

FIG. 5 is a view showing the inventive candle or scented wax book or card shut closed and laying flat on its back panel's outer surface.

FIG. 6 is a view comparable to FIG. 5 except showing the candle or scented wax book or card stood jointly on its front and back panels' fore edges.

FIG. 7 is a view comparable to FIG. 1 except showing alternate embodiments of candle or scented wax books or cards in accordance with the invention.

FIG. 8 is a view comparable to FIG. 5 except showing another embodiment of a candle or scented wax book or card in accordance with the invention.

FIG. 9 is a view comparable to FIG. 7 except showing additional embodiments of candle or scented wax books or cards in accordance with the invention.

FIG. 10 is a view comparable to FIG. 7 except showing a further embodiment of a candle or scented wax book or card in accordance with the invention.

FIG. 11 is a view comparable to FIG. 7 except showing still additional embodiments of candle or scented wax books or cards in accordance with the invention.

FIG. 12 is a view comparable to FIG. 7 except showing a still further embodiment of a candle or scented wax book or card in accordance with the invention.

DETAILED DESCRIPTION OF THE PREFERRED EMBODIMENTS

Figure 1:
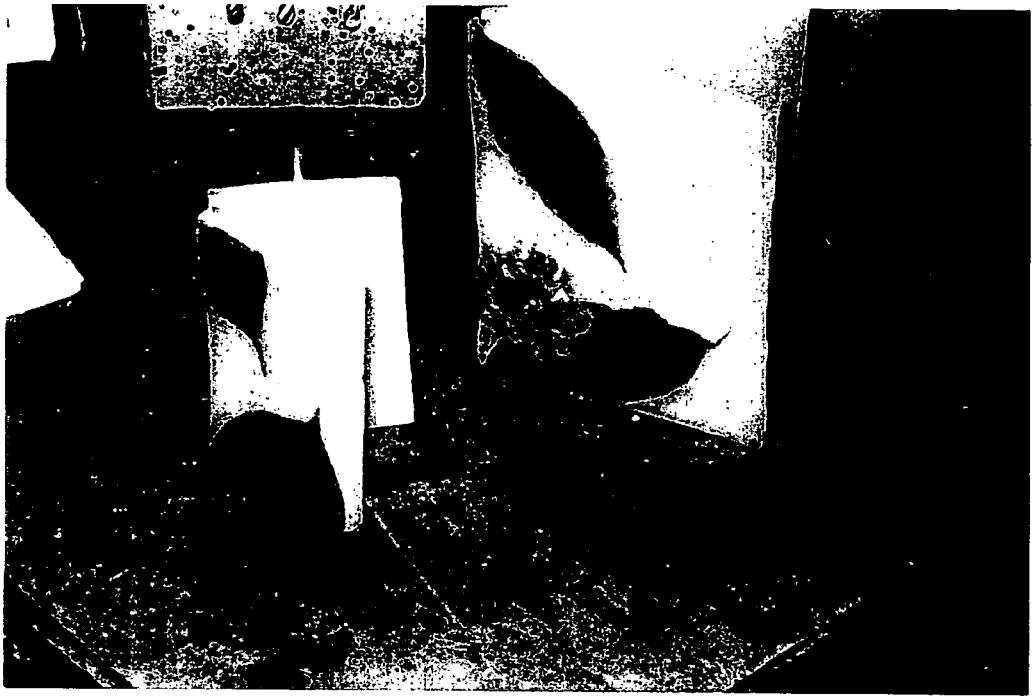

FIG. 1 shows various preferred embodiments of candle or scented-wax books or cards in accordance with the invention. A candle or scented-wax book or card in accordance with the invention comprises a pair of comparably-sized planar panels of wax conjoined by a flexible, non-wax hinge material in order to allow relative movement in the fashion of being able to spread open or shut close in the manners of cards or, fairly similarly, the covers of books. Each book or card comprises a front and back panel. Each panel comprises an outer and inner face spaced apart by a perimeter frame comprising upper and lower edges, a spine edge, and a fore edge. FIG. 1 also shows that candle or scented-wax books or cards in accordance with the invention can be produced in various sizes, and so this illustration serves to show that the invention is neither limited to a specific size nor else to specific aspect ratios such as either a ratio of width to height or else to thickness of the panels. In this view, the two books (or cards) featured in the foreground are spread open to about a 30° angle to show that they can stably stand upright without external propping.

Figure 2:
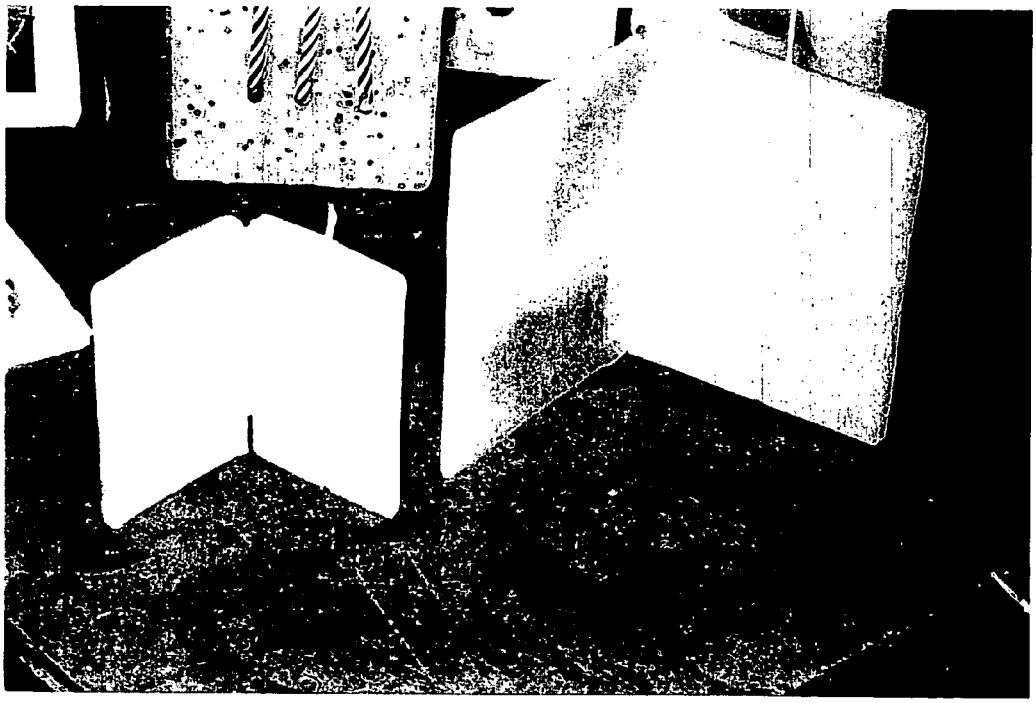

FIG. 2 is a view comparable to FIG. 1 except that the two books (or cards) featured in the foreground are shown half-open (eg., sweeping out about a 90° angle from being fully shut closed), in order to better show how they may be arranged to be both self-standing while at the same time allowing observers to study and/or view any matter (none shown, but see FIG. 4 or 10) on either of the panels' inner faces.

Figure 3:
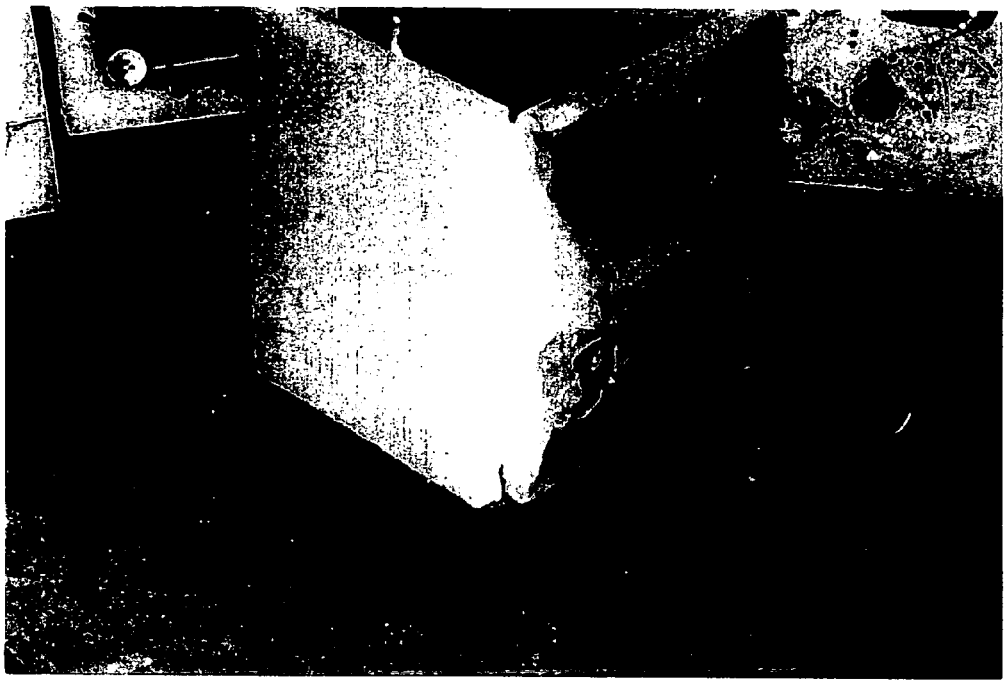
Figure 4:
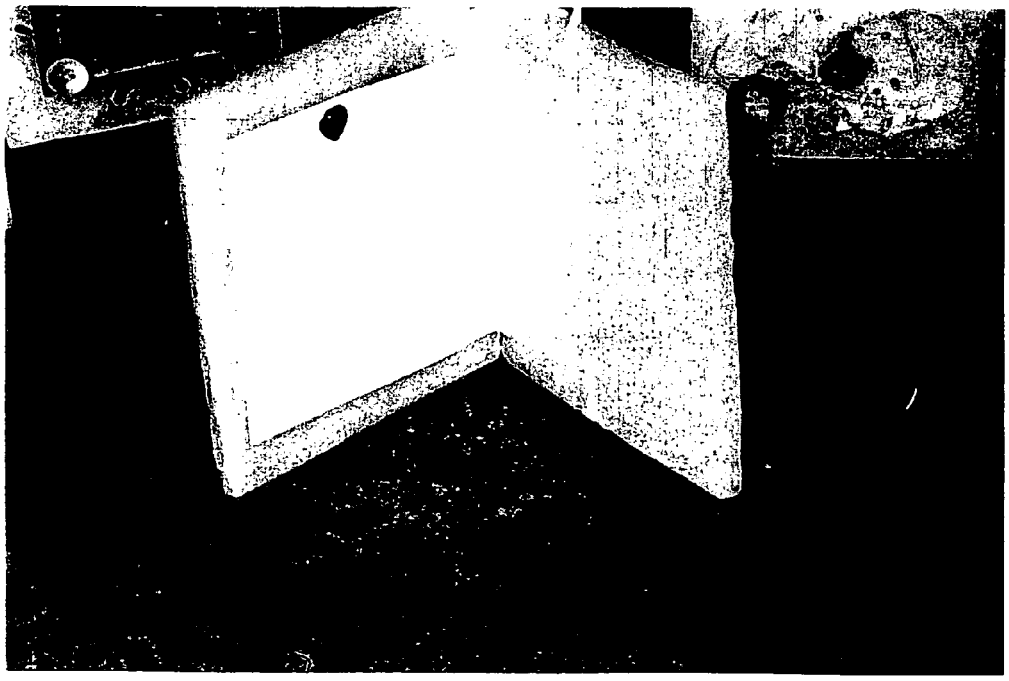

FIGS. 3 and 4 show the following. An example candle or scented-wax book or card in accordance with the invention preferably comprises a front panel and a back panel joined together by a binder (shown better in FIG. 4) allowing opening and closing of the panels. The panels are predominantly formed of wax and most preferably scented wax. To date, the wax panels are preferably produced as by pouring flat stock to yield a base or core in a flat condition and then allowing it all to harden. After hardening, the panel stock is retrieved and four edges of each panel are sized as shown for example in FIGS. 3 and 4, approximately the size of a common-size of greeting card (eg., 5 inches by 3¾ inches or, alternatively, 127 mm by 95 mm). To date, panel thickness preferably measures about 3/16-ths inches (~4¾ mm). One or both panels preferably incorporates a wick (in the drawings, shown incorporated in the back panel). The wick as shown extends along a vertical axis (as the oriented in this view). The wick further provides an upper tag end projecting out of the vertical upper edge of said one panel. As mentioned previously, the flat stock serves as a "base" or "core" because ornaments or adornments as described more particularly below are adhered or affixed to the base or core by encasing in further thin layers of wax to the base or core.

Each panel's inner and outer face affords opportunities for both decorating and/or supporting attachments as will be more particularly reviewed in the discussion that follows with these FIGS. 3 and 4 as well as the remaining set of views of the drawings. For instance, FIG. 3 shows that the front panel's outer face is decorated with artificial leaves (of paper or synthetic material) and a wax flower. The artificial leaves are added to the outer face after the original pouring of the base (eg., the predominant portion of the front panel). The leaves can be affixed or adhered by pouring over a thin layer of additional wax or else wax may be dripped over the wax leaves in order to obtain the thin amount of wax needed to sufficiently affix, adhere and/or encase the leaves as desired. The wax flower is created in much the same way as cake decorators use icing to make flowers. Namely, the flower can be pre-made and then attached later by softening the wax interface between the flower and front panel's outer face. Or else the flower can be created directly onto the outer face at the time of the flower's creation. In sum, the leaves and flower provide decoration as well as texture to the front panel's outer face.

In contrast, FIG. 4 shows that the front panel's inner face provides a surface for attaching paper or cardstock and the like. The paper or cardstock can be affixed simply by small metal pins or brads as shown (only one shown). That way, long after the invention candle or scented wax book or candle has left the factory, the end-customer such as the sending party can author an original message for the benefit of the receiving party. Alternatively, the either inner face of either the front or back panel can be affixed with paper or cardstock encased by dripped or poured wax. In that situation, however, the artwork and/or message on the paper or cardstock would have to put down before the encasing wax is dripped or poured onto it. As a consequence, the factory offers the last chance to put something original on that paper or cardstock before the candle or book is shipped in commerce. It might be preferred if the front panel's inside cover is given a waxed over, factory message while the back panel's inside cover is given dry paper or cardstock in order to allow customers to personalize the book or card as they wish.

Figure 5:
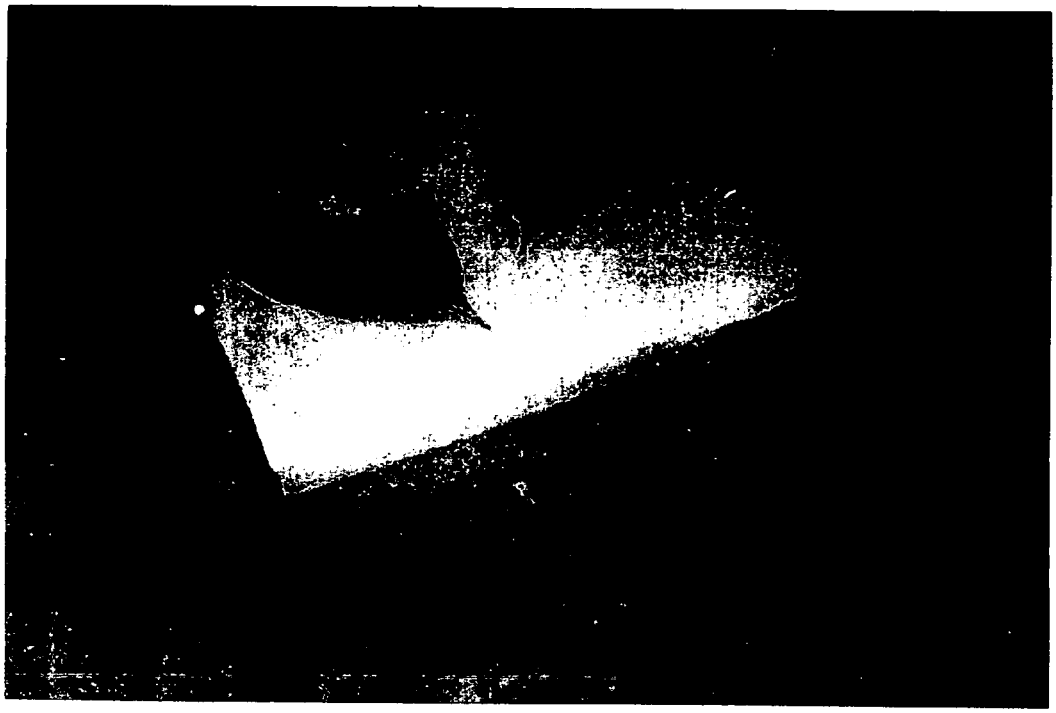

FIG. 5 shows the inventive candle or scented wax book or card shut closed and laying flat on its back panel's outer face.

Figure 6:
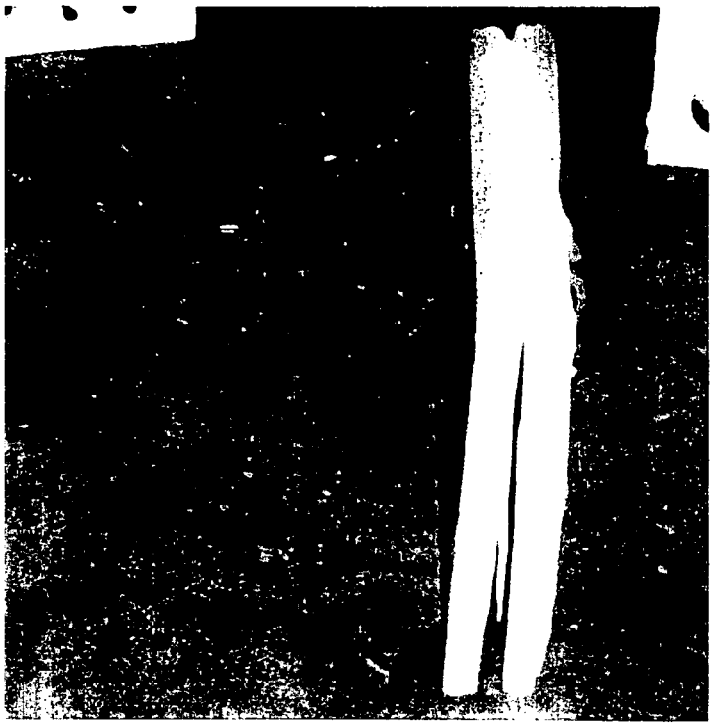

FIG. 6 is comparable to FIG. 5 except showing the candle or scented wax book or card stood on its panel's fore edges in order to better show the spine of the book or card when shut closed. The binder material can comprise any suitable material including without limitation velum (as shown), or a swatch of fabric or patch of antique leather and so on.

Figure 7:
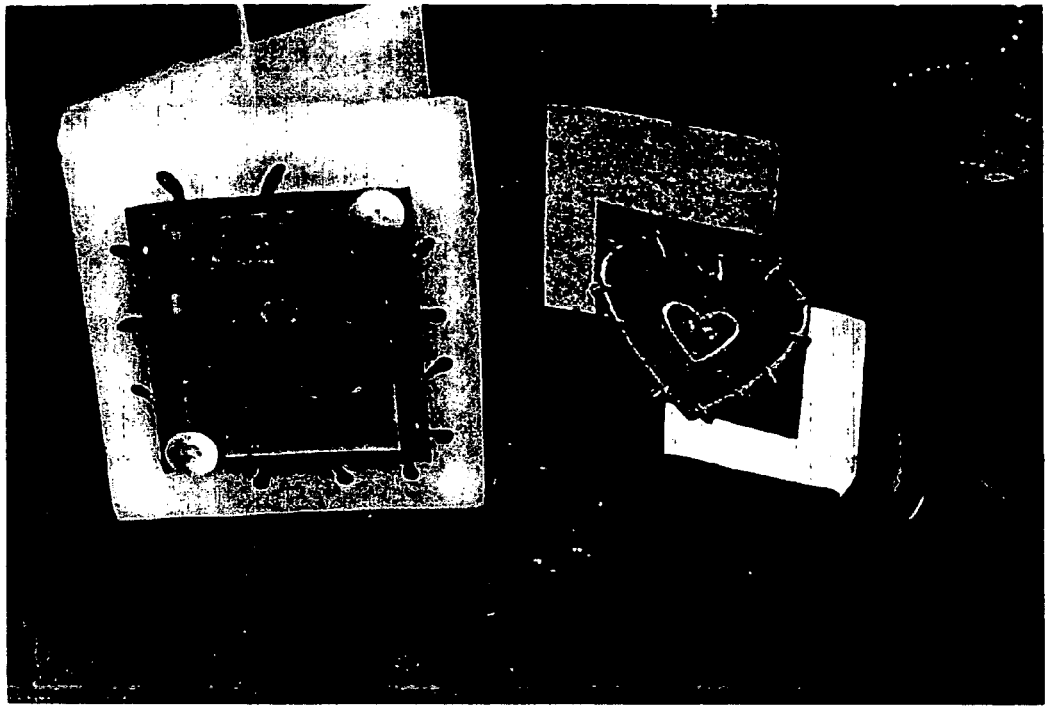

FIG. 7 shows two alternate versions of the invention. The left-side version has a front panel's outer face decorated with a graphic work of artistry comprising a teddy bear, wherein two corners of the rectangle of the main image are trimmed out with antique buttons. The right-side version shows a front panel's outer face done up in Valentine's Day motifs.

Figure 8:
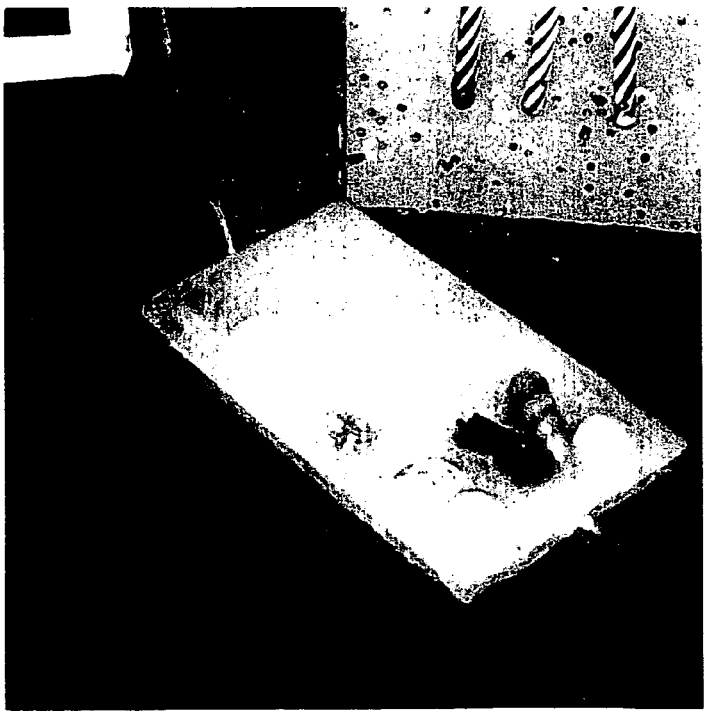

In FIG. 8, the inventive candle or scented wax book or card which is shut closed and laying flat shows a front panel having adornments—in particular although serving a non-limiting example, seashells—interspersed and frozen in the main matrix of the base or core of wax that constitutes said front panel. The seashells project outwardly in relief from the major plane of the front panel's outer face for intended results relating to both ornament and texture.

Figure 9:
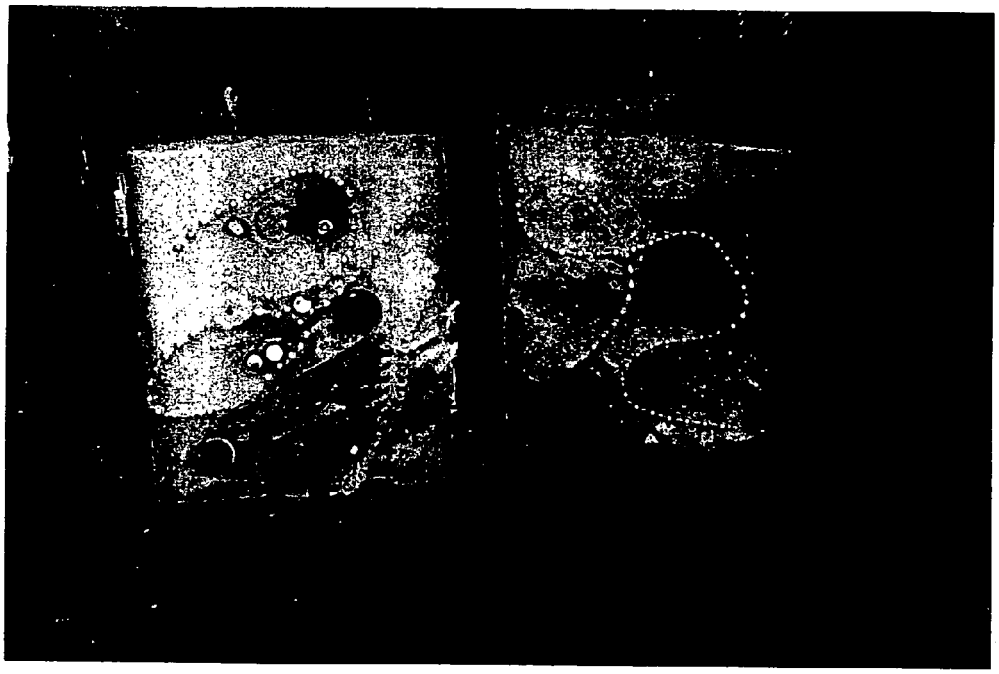

FIG. 9 shows a pair of comparably decorated candle or scented wax book or candles, these which feature front panel's carrying and/or encasing pearls on a string and other loose gems (all artificial, barring exceptional considerations to the contrary), antique buttons and synthetic leaves or flowers and/or vegetation and so on.

Figure 10:
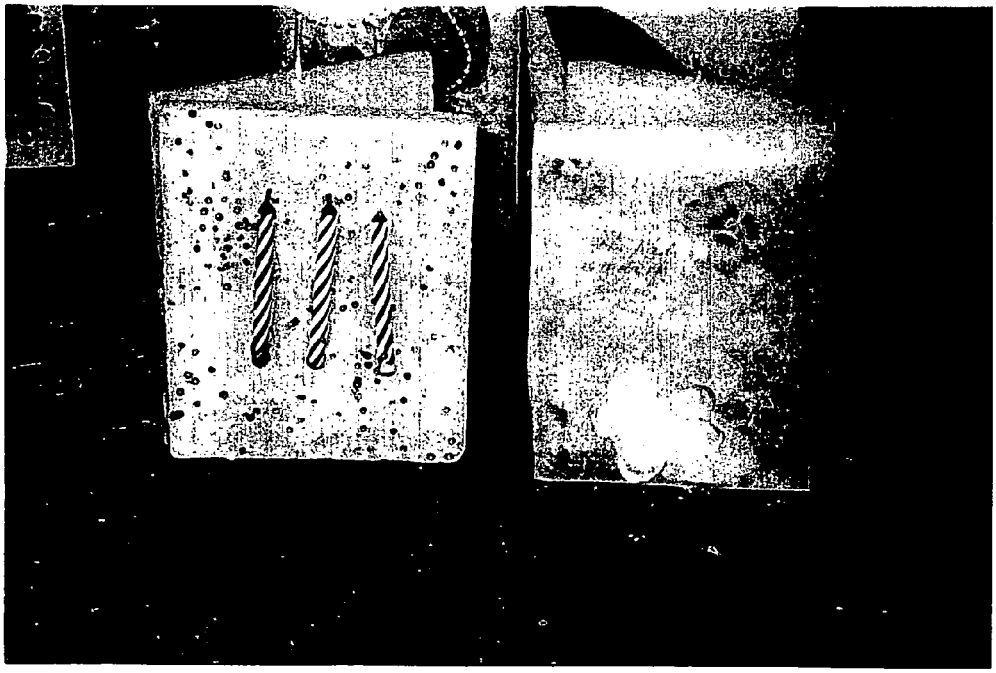

FIG. 10 shows two further versions of the invention. The left-side version has a front panel's outer face carrying birthday-cake candles and glitter, all which can be directly melted into or on top of the major plane of the front panel's outer face by re-heating a cold blank panel (not shown in this view).

In FIG. 10, the right-side version shows a front panel's inner face. It is an aspect of the invention that either face (eg., of the inner or outer faces thereof) of either panel (eg., of the front and back panels thereof) may encase (or seal-in) or otherwise secure media of print materials. This allows the candle or scented-wax book or card in accordance with the invention to compete in a market segment presently dominated by paper greeting cards. That is, the candle or scented-wax book or card in accordance with the invention just as readily affords the opportunity to present professional messages and designs as greeting cards, in as about a compact package as to readily allow and survive mailing through the U.S. Postal Service's First Class mail service.

Figure 11:
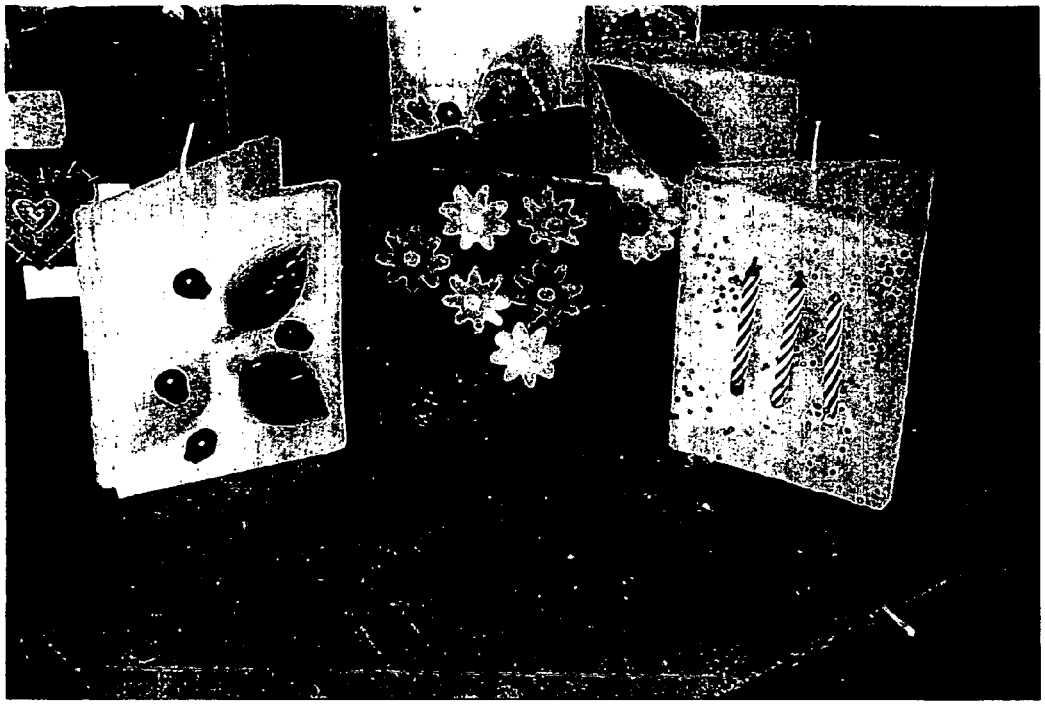

FIG. 11 shows yet another two further versions of the invention (of the three versions shown in foreground, as the birthday card version is shown previously in FIG. 10). The furthest-left foreground version has a front panel's outer face affixed with wax leaves and cut-outs of ladybug designs. The middle-foreground version shows a front panel's outer face affixed with wax flowers and wax stems and other vegetation.

Figure 12:
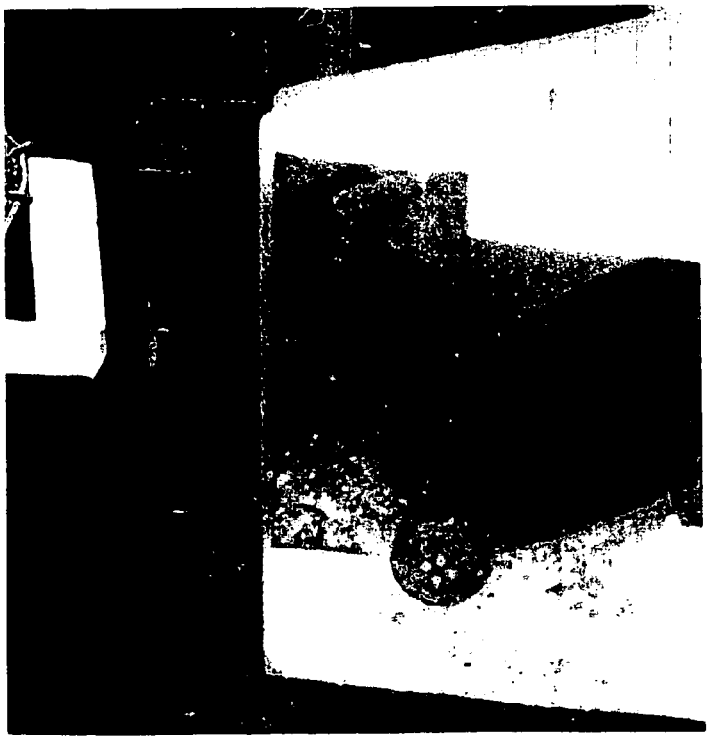

FIG. 12 shows still a further version of the invention, and although this represents the final view of the set, it is not an exhaustion of the possibilities afforded by the advantages of the invention because truly the possibilities might be endless. Referencing FIG. 12 more particularly, it shows a front panel's outer face affixed with sealed in patches or geometries of paper or card stock (eg., velum in this instance), as well as an artificial leaf and antique button, wherein the dripped or poured on sealing layer is also impregnated with sand for further effects of ornament and/texture.

The wax utilized for producing the invention can be selected optionally from any of and without limitation beeswax, carnauba wax, paraffin wax, soy wax, liquid wax, pillar wax, and/or granular wax. It is preferred to scent, or in other words, imbue the wax with a scent substance, so that the resultant article further functions as a disguised air freshener. The means of imbuing such scenting or fragrant substance(s) to the wax can be achieved by alternative ways such as a process of pre-mixing the scenting or fragrant substance(s) into a container of hot wax before it is poured into flat sheets to produce panel stock, or alternatively by accomplishing absorption of the scent substance into wax at an elevated temperature. That is, while the wax is still warm after being poured, the scenting or fragrant substance(s) can be "infused" after the fact into the poured hot wax as by wet or aerosol spraying, or alternatively by dipping (dunking) the warm panel stock into containers of such scenting or fragrant substance(s). That way, the scenting or fragrant substance(s) are afforded a time slot to infuse or absorb into the warm wax before the poured flat-sheet panel stock cools too much and becomes relatively more resistant to the infusion and/or absorption actions. Which way to proceed depends in part on the chosen scenting or fragrant substance(s).

Example scenting or fragrant substance(s) suitable for the purpose include without limitation various scented, fragrant or aromatic liquids and solids. Preferred scenting or fragrant substance(s) would comprise a group chosen from essential oils, perfume oils, extracts which emit a scent, fragrance, aroma or perfume regardless whether such extracts are alcohol-based or otherwise, such as glycerin-based as is known in the art. Indeed, evenly relatively finely pulverized solid materials such as salts, hard resins, or wood chips/dust can be pre-mixed as by stirring or agitating into a container of dip-coating material or else combined with an atomized or squirting stream of spray-coating material. Given the foregoing, persons having ordinary skill in the art will readily appreciate that routine trial and error affords ample opportunities to combine various diverse compounds of scenting or fragrant substance(s) to work toward any desired end result.

The scent-emitting power of the scented-wax book or card in accordance with the invention naturally declines with age. However, for a certain number of times, users can re-invigorate the scent-emitting power by mildly warming up such an aging scented-wax book or card in accordance with the invention. This can be readily achieved with a conventional hair dryer among other ways to do so.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A wax greeting card comprising:

a front and a back panel of wax, each having inner and outer faces framed by a perimeter of spaced upper and lower edges as well as a spaced spine and fore edge;

a flexible hinge extending across the spine edges of the front and back panels and anchored in each panel by being cemented in the wax thereof, said flexible hinge allowing relative movement between the front and back panels ranging from a shut closed position to various spread open positions; and a wick contained in one of the panels, said wick extending along an axis generally parallel to the spine edge thereof, said wick having an upper tag end projecting out of the upper edge of said one of the panels.

2. The wax greeting card of claim 1 further comprising non-wax ornaments interspersed and adhered to or frozen in the wax of either panel and being exposed on one or the other of either surface of such either panel.

3. The wax greeting card of claim 2 wherein said wax ornaments comprise any of simulative vegetation, simulative flowers, simulative insects, clippings of two-dimensional artwork, birthday cake candles, strings of fake pearls, buttons, or mineral matter including seashells.

4. The wax greeting card of claim 3 wherein said clippings of two-dimensional artwork comprises holiday theme artwork including hearts for the Valentines holiday.

5. The wax greeting card of claim 1 further comprising seashells interspersed and frozen in the wax of either panel and being exposed on as well as projecting out to provide texture to one or the other of either surface of such either panel.

6. The wax greeting card of claim 1 wherein the wax comprises any of beeswax, carnauba wax, paraffin wax, soy wax, liquid wax, pillar wax, and/or granular wax.

7. The wax greeting card of claim 1 further comprising a scent substance imbued in the wax of the panels so that the wax greeting card functions as a disguised air freshener, wherein the scent substance comprises any of essential oils, perfume oils, alcohol- or glycerin-based extracts, and/or finely pulverized solid materials including any of salts, hard resins, wood chips, and/or wood dust.

8. The wax greeting card of claim 1 wherein the flexible hinge and wax panels are cooperatively arranges such that the wax greeting card can be set self-standing on a support surface by resting on the lower edges of both panels when disposed in a partly spread open position relative each other.

9. The wax greeting card of claim 1 wherein said flexible hinge comprises any of a swatch of velum, fabric, or leather.

10. A wax-based article comprising:

a pair of planar panels substantially of wax, each panel having inner and outer faces framed by a perimeter of spaced upper and lower edges as well as a spaced spine and fore edge;

a flexible hinge extending across the spine edges of the panels and anchored in each panel by being cemented in the wax thereof, said flexible hinge allowing relative movement between the front and back panels ranging from a shut closed position to various spread open positions and;

a wick contained in one of the panels, said wick extending along an axis generally parallel to the spine edge thereof, said wick having an upper tag end projecting out of the upper edge of said one of the panels.

11. The wax-based article of claim 10 further comprising non-wax ornaments interspersed and adhered to or frozen in the wax of either panel and being exposed on one or the other of either surface of such either panel.

12. The wax-based article of claim 11 wherein said wax ornaments comprise any of simulative vegetation, simulative flowers, simulative insects, clippings of two-dimensional artwork, birthday cake candles, strings of fake pearls, buttons, or mineral matter including seashells.

13. The wax-based article of claim 10 further comprising seashells interspersed and frozen in the wax of either panel and being exposed on as well as projecting out to provide texture to one or the other of either surface of such either panel.

14. The wax-based article of claim 10 wherein the wax comprises any of beeswax, carnauba wax, paraffin wax, soy wax, liquid wax, pillar wax, and/or granular wax.

15. The wax-based article of claim 10 further comprising a scent substance imbued in the wax of the panels so that the wax-based article functions as a disguised air freshener, wherein the scent substance comprises any of essential oils, perfume oils, alcohol- or glycerin-based extracts, and/or finely pulverized solid materials including any of salts, hard resins, wood chips, and/or wood dust.

16. The wax-based article of claim 10 wherein the flexible hinge and wax panels are cooperatively arranges such that the wax-based article can be set self-standing on a support surface by resting on the lower edges of both panels when disposed in a partly spread open position relative each other.

17. The wax-based article of claim 10 wherein said flexible hinge comprises any of a swatch of velum, fabric, or leather.

18. The wax-based article of claim 10 wherein of either panel further comprises the encasement therein or adherence thereto of media of print materials.

* * * * *